US009440142B2

(12) United States Patent
Campion et al.

(10) Patent No.: US 9,440,142 B2
(45) **Date of Patent: *Sep. 13, 2016**

(54) BLOCKING MECHANISM FOR AMUSEMENT GAME WITH MULTIPLE LIFTING PINS

(71) Applicant: Mega Mania Diversions LLC, Commerce Township, MI (US)

(72) Inventors: Donald C. Campion, Commerce Township, MI (US); Xiwen Jiang, Shanghai (CN); Xi Qingyuan, Hefei (CN)

(73) Assignee: Mega Mania Diversons LLC, Commerce Township, MI (US)

( * ) Notice: Subject to any disclaimer, the term of this patent is extended or adjusted under 35 U.S.C. 154(b) by 32 days.

This patent is subject to a terminal disclaimer.

(21) Appl. No.: 14/023,941

(22) Filed: Sep. 11, 2013

(65) Prior Publication Data

US 2014/0077452 A1 Mar. 20, 2014

Related U.S. Application Data

(63) Continuation-in-part of application No. 13/165,020, filed on Jun. 21, 2011, now Pat. No. 8,888,096.

(51) Int. Cl.

| | |
|---|---|
| ***A63F 7/00*** | (2006.01) |
| ***A63F 7/07*** | (2006.01) |
| ***A63F 7/30*** | (2006.01) |
| ***A63D 1/02*** | (2006.01) |
| ***A63D 3/00*** | (2006.01) |

(52) U.S. Cl.

CPC . *A63F 7/30* (2013.01); *A63D 3/00* (2013.01); *A63F 7/0005* (2013.01); *A63F 2007/309* (2013.01); *A63F 2250/14* (2013.01)

(58) Field of Classification Search

CPC .... A63F 7/005; A63F 7/30; A63F 2007/309; A63F 2250/14; A63D 3/00

USPC ..... 273/317.3, 397, 126 R, 126 A, 108, 273/118 R, 118 A; 473/480, 481, 106, 115, 473/116, 4, 24

See application file for complete search history.

(56) References Cited

U.S. PATENT DOCUMENTS

| | | | | |
|---|---|---|---|---|
| 4,013,292 | A * | 3/1977 | Cohen et al. | 273/371 |
| 4,126,217 | A * | 11/1978 | Bock | 194/291 |
| 4,215,863 | A * | 8/1980 | Kuiper | 273/126 R |
| 4,805,917 | A * | 2/1989 | Cochran et al. | 273/397 |
| 5,011,147 | A * | 4/1991 | Thomas et al. | 273/126 A |
| 5,199,598 | A * | 4/1993 | Sampson | 221/194 |
| 5,330,175 | A * | 7/1994 | Kim | 273/397 |
| 5,556,093 | A * | 9/1996 | Lankiewicz et al. | 273/126 A |
| 5,704,612 | A * | 1/1998 | Kelly et al. | 273/402 |
| 5,785,313 | A * | 7/1998 | Shiraishi | 273/108.1 |
| 5,842,699 | A * | 12/1998 | Mirando et al. | 273/317.3 |
| 6,536,770 | B1 * | 3/2003 | Yang | 273/317.3 |

(Continued)

*Primary Examiner* — Sebastiano Passaniti

(74) *Attorney, Agent, or Firm* — Marshall & Melhorn, LLC

(57) ABSTRACT

A blocking mechanism for a table-type amusement game, and a table-type amusement game equipped with a blocking mechanism. The blocking mechanism utilizes a series of blocking pins goes from a closed position, which blocks a playing piece from scoring to an upper open position, which permits the playing piece to score. The blocking mechanism may be manually or electrically operated. When the blocking mechanism is electrically operated, it may be activated by the insertion of a coin into a coin and/or bill acceptor of the type found on table-type amusement games.

11 Claims, 6 Drawing Sheets

(56) References Cited

U.S. PATENT DOCUMENTS 7,261,293 B2 * 8/2007 Berger ..... 273/118 R
8,888,096 B2 * 11/2014 Campion et al. ..... 273/108
2012/0142458 A1 * 6/2012 He et al. ..... 473/480

* cited by examiner

BLOCKING MECHANISM FOR AMUSEMENT GAME WITH MULTIPLE LIFTING PINS

RELATED APPLICATION

This application is a continuation-in-part of application Ser. No. 13/165,020, filed Jun. 21, 2011, for Blocking Mechanism for Amusement Game. Application Ser. No. 13/165,020 is pending as of the filing date of the present application.

FIELD OF THE INVENTION

The present invention relates to amusement games. More particularly, the present invention relates to table-type amusement games. Most particularly, the present invention relates to a blocking device which will prevent the table-type amusement game from being played without the payment of the fee for playing the game.

BACKGROUND OF THE INVENTION

For as long as there have been amusement table games, there have been efforts on the part of certain people who wish to use the amusement game table to play the game without the payment of the required fee.

Previous solutions for this type of problem have either been relatively expensive, or easily defeated. For example, for shuffleboard type table games there is known in the art a mechanism that does not release the shuffleboard pucks to the player until the fee is deposited, and then does not return the puck to the player once the game is completed. Similarly, for bowling table-type games, a bowling ball will not be released to the player until the fee is deposited, and then after a certain number of frames, the ball will not be returned to the player.

Other blocking mechanisms for "shuffleboard-type" games are known, but may be easily forced from their closed position to their open position, allowing the games to be played without the patrons paying.

For the above reasons, those skilled in the art continue to search for a simple and less expensive solution to the problems in the art.

SUMMARY OF THE INVENTION

The present invention provides a novel and unique solution to the above-mentioned problems in the art by providing an automatic blocking mechanism which prevents the playing piece of table-type amusement games, such as tabletop bowling and tabletop shuffleboard, from being played without payment of the requisite fee. A blocking means which is operated upon depositing the fee into a coin and/or bill acceptor of a tabletop amusement game, remains in its closed position before the fee is deposited, opens when the fee is deposited, and closes again after the game is completed, whether by a certain event occurring, such as the playing of a certain number of innings, frames, etc., elapsing of a certain amount of time, or other events.

BRIEF DESCRIPTION OF THE DRAWINGS

The above, as well as other advantages of the present invention will become readily apparent to those skilled in the art from the following detailed description when considered in the light of the accompanying drawings in which:

FIG. 6 is a perspective view, partially cut away, of the blocking mechanism. The blocking mechanism is shown in its down or closed position. Due to spring pressure on the blocking pins, they are all in a position close to the playing surface of the amusement game, blocking any playing piece from passing through. Any attempt to raise one or more blocking pins leaves the other pins down, effectively blocking any playing pieces from passing through.

DETAILED DESCRIPTION OF THE PREFERRED EMBODIMENTS

Figure 1:
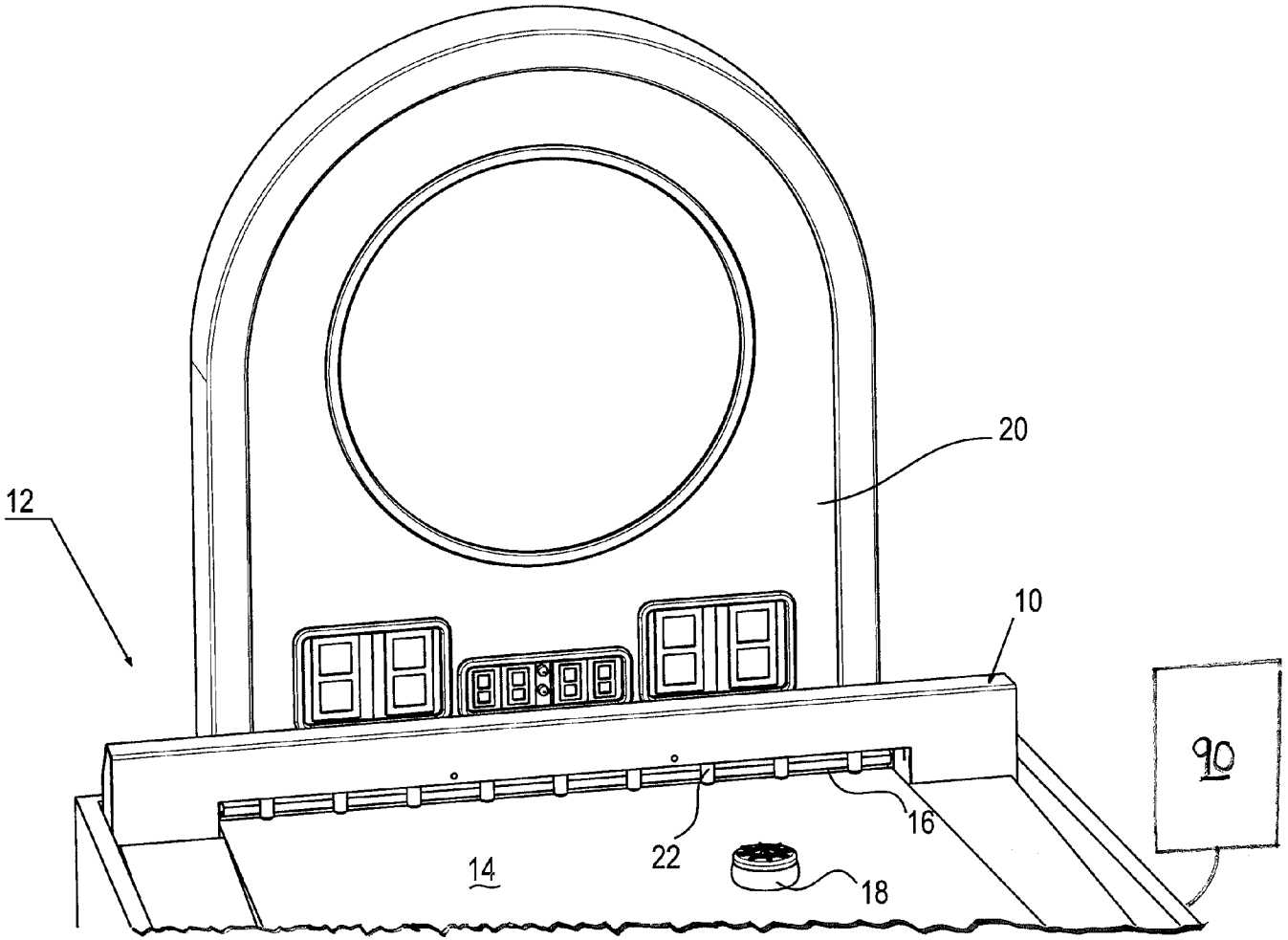
FIG. 1 is a perspective view, partially cut away, of a construction embodying the present invention mounted on a shuffleboard type amusement game immediately in front of the bumper bar, whereby the blocking pins prevent the playing of the game when they are in the down position.

Referring to FIG. 1, there is shown a blocking mechanism construction embodying the present invention, generally designated the numeral 10, mounted on a conventional bumper type shuffleboard amusement table game 12. The blocking mechanism 10 is mounted above the playing surface 14, immediately in front of the bumper 16. An electronic scoreboard 20, of a type well known in the art, is provided to keep score while the game is being played.

In a preferred embodiment, when the blocking mechanism 10 is in the down position, the blocking pins 22 are in front of the shuffleboard bumper 16, thus preventing the puck 18 from bouncing off the bumper 16, hence preventing play. When the fee is paid to the coin and/or bill acceptor, the blocking pins 22 move to the up position, thus allowing play.

Figures 2, 2A:
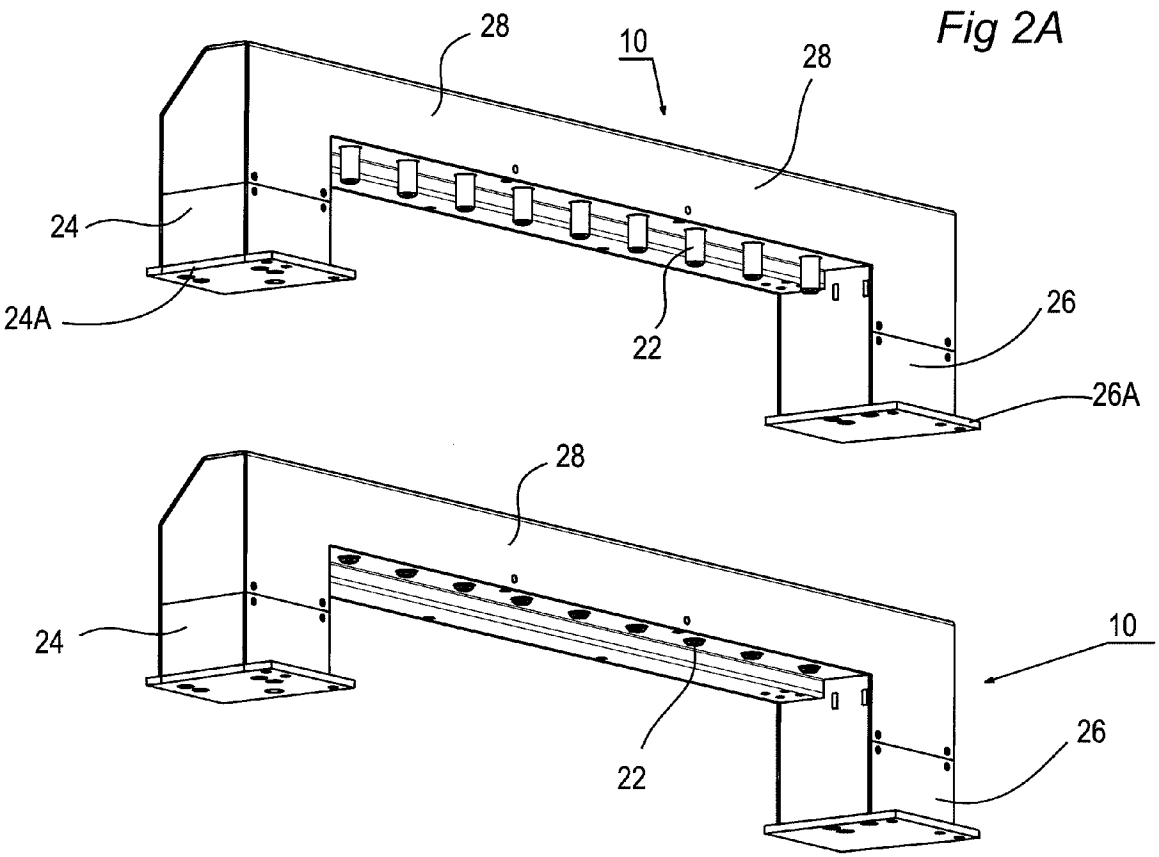
FIG. 2 is a perspective view taken from the underside of a construction embodying the present invention and showing the blocking pins in their raised position.
FIG. 2A is a bottom perspective view of a construction embodying the present invention showing the blocking pins in their lowered position.

With reference to FIG. 2, the blocking pins 22 are shown in their raised position (open status). In the Open Status, the pins are retracted up into the blocking mechanism 10, and are out of the way of the puck 18.

With reference to FIG. 2A, the blocking pins 22 are shown in their lowered position (Closed Status). In the closed status, the pins are lowered and will interfere with the puck 18. Also shown is a first or left-hand base portion 24 having a left-hand mounting plate 24A, and a second or right-hand base portion 26 having a right-hand mounting plate 26A. A cover 28 is also shown.

Figure 3:
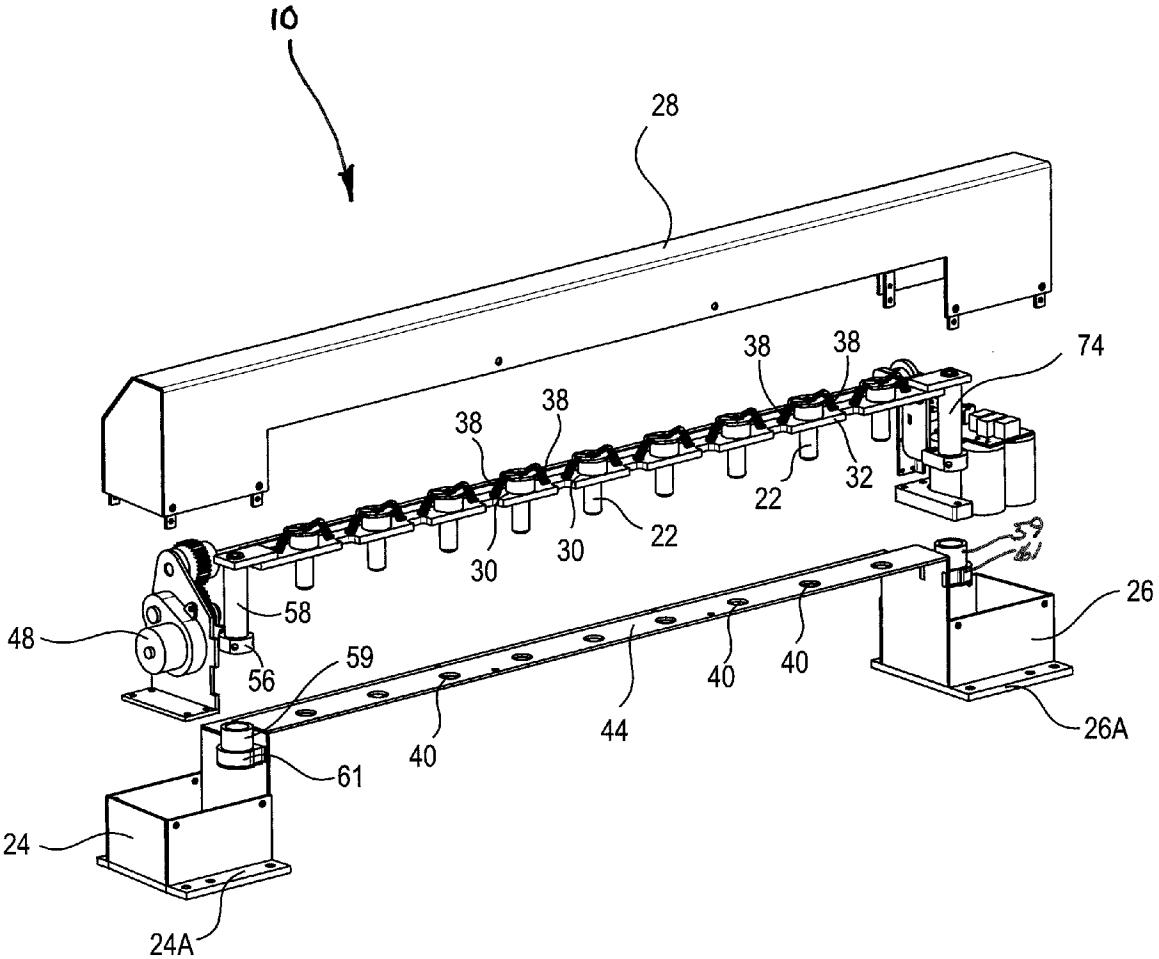
FIG. 3 is an exploded perspective view of a construction embodying the present invention.

With reference to FIG. 3, there is shown an exploded view of the improved blocking mechanism 10. The blocking pins 22 all rest on and protrude through a plurality of pin openings 30 in a horizontal support bar 32.

Figure 6:
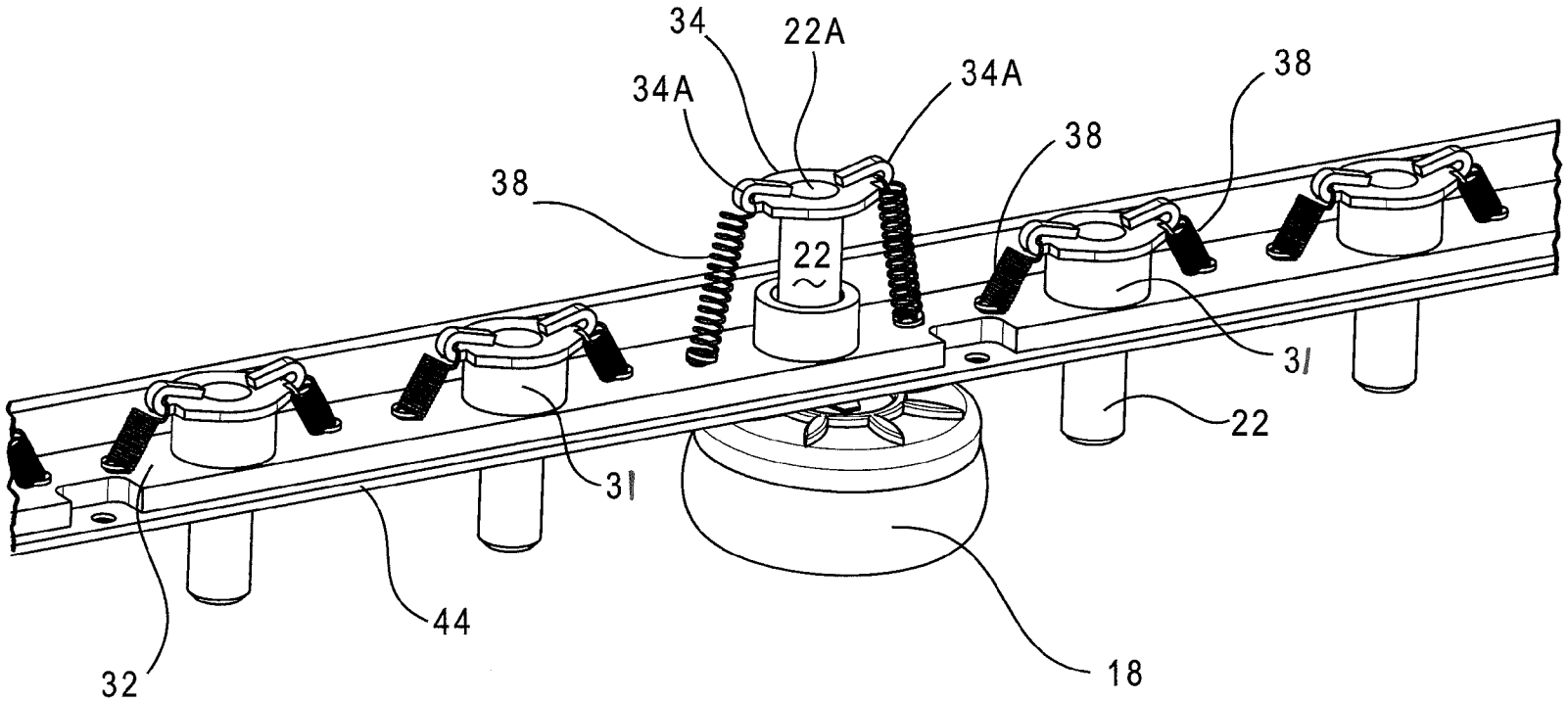

Referring to FIGS. 3 and 6, it can be seen that shaft sleeves 31 are provided above each pin opening 30 to help guide the blocking pins 22 up and down therein. The top of each blocking pin 22 has a reduced portion 22A to which a spring mounting plate 34 is attached thereto. Each spring mounting plate 34 has a pair of hooks 34A. A pair of springs 38 is mounted between the horizontal support bar 32 and the hooks 34A to make the blocking pins 22 spring-loaded. The combination of the horizontal mounting bar 32, blocking pins 22, spring mounting plates 34 and springs 38 comprise the blocking means of the present invention.

Figure 4:
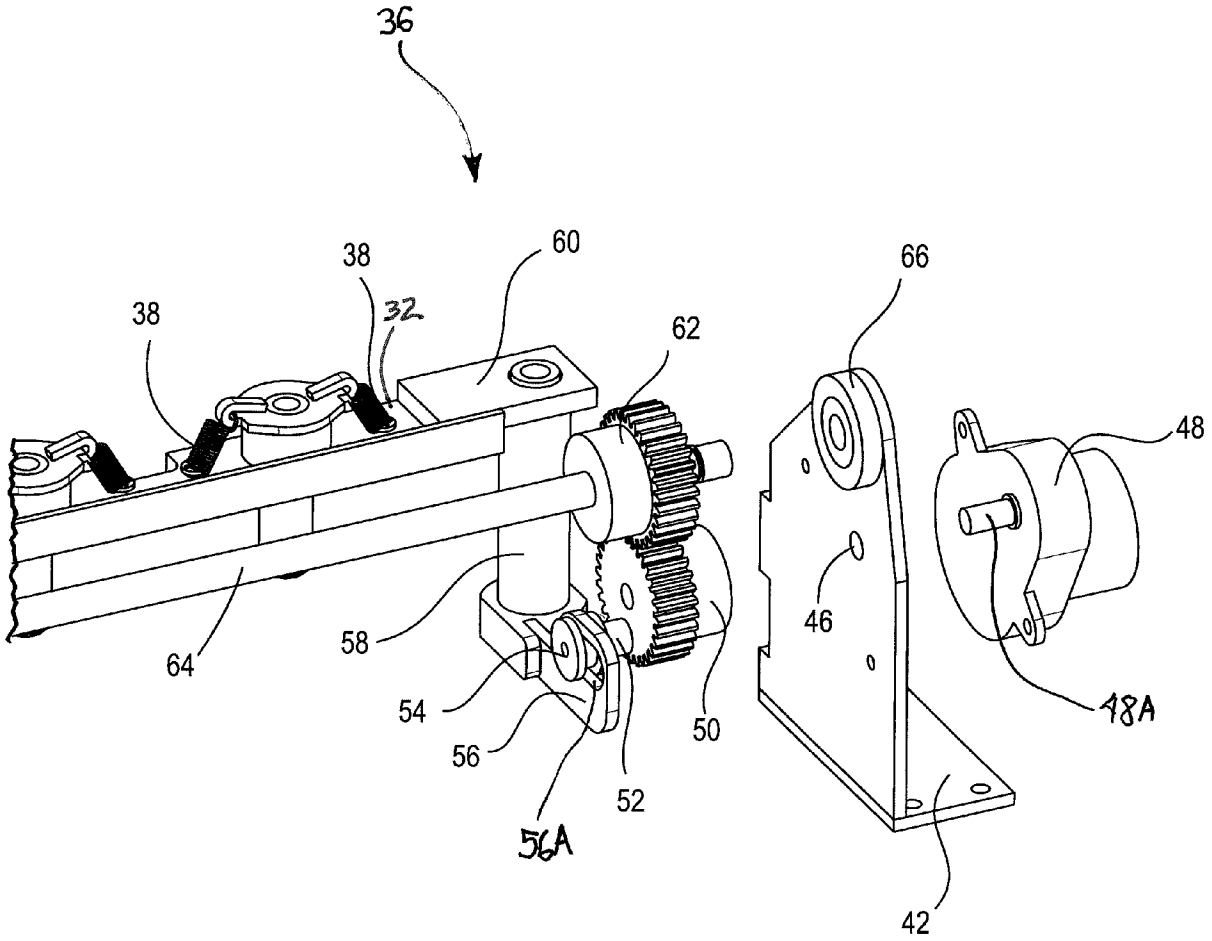
FIG. 4 is an exploded perspective view of one end of the construction shown in FIG. 3, partially cut away.
Figure 5:
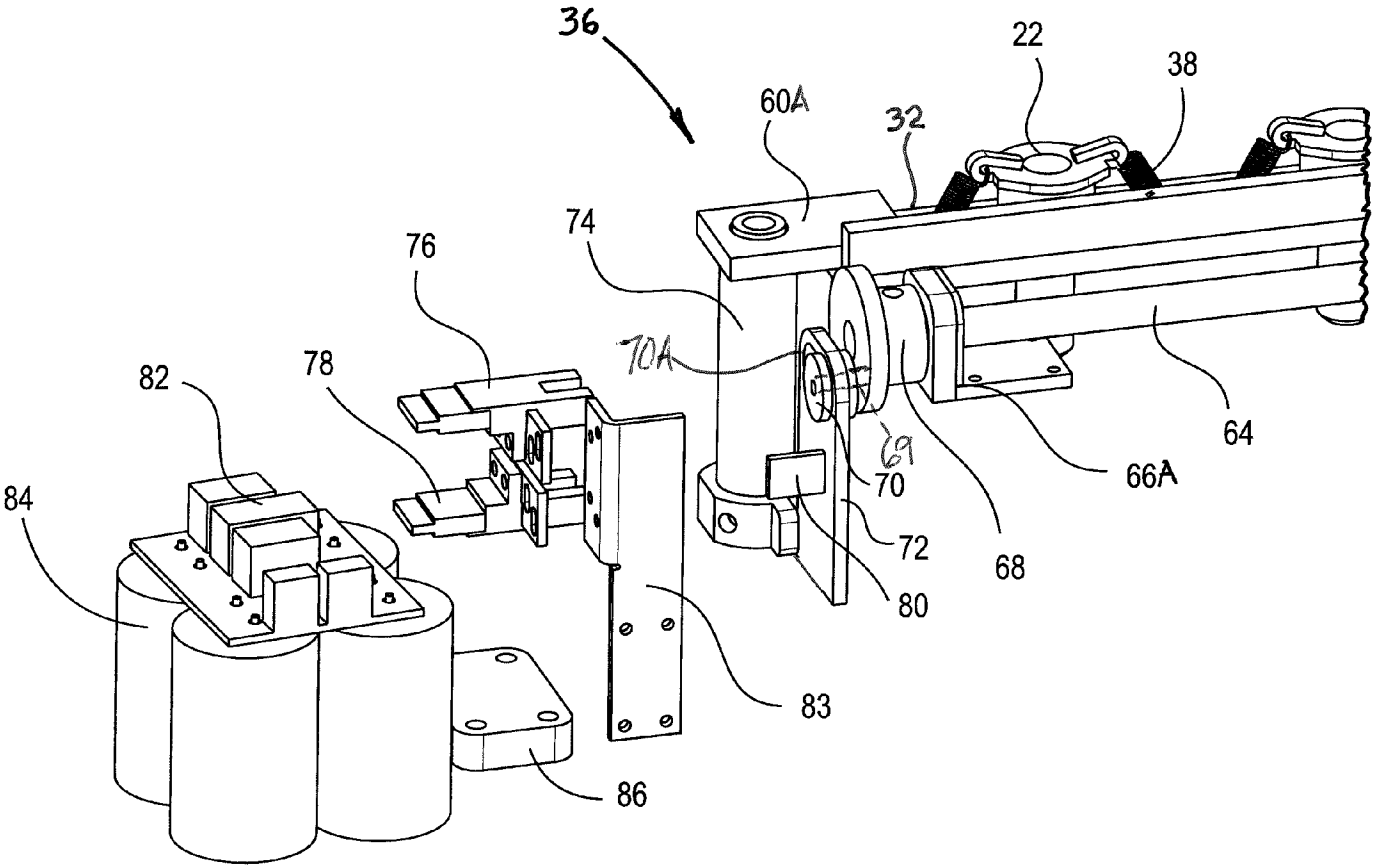
FIG. 5 is an exploded view of the other end of the construction shown in FIG. 3, partially cut away.

It can be seen that a blocking pin 22 may be forced up to try to push a puck 18 therethrough, but the other pins 22 would still be down and the puck 18 would not be able to bounce off the bumper, thereby completely defeating those who wish to play the game without paying the fee. Referring now to FIGS. 4 and 5, it can be seen how the horizontal support bar 32 is reciprocated by the lifting or reciprocating means 36 with respect to the guide plate 44. A motor mounting plate 42 is provided which is attached to the first or left-hand base member 24. Motor 48 is attached to the motor mounting plate 42. The motor shaft 48A protrudes through the shaft opening 46. There is fixedly mounted to the motor shaft 48A a driving gear 50. To the driving gear 50 is mounted a first or left crankshaft 52, which has cam follower 54 mounted thereon. The cam follower 54 is rotatably mounted to the driving gear 50 and the grooved portion 54A thereof is sized to fit into the oblong opening 56A in the first or left pull plate 56. As the driving gear rotates, the lifting shaft 58 will reciprocate in a vertical direction lifting the horizontal support bar 32 away from the guide plate 44. A crossbar 60 connects the lifting shaft 58 to the horizontal support bar 32.

The lifting shaft 58 is constrained to move in a vertical direction by the shaft sleeve 59 (FIG. 3) which is mounted to shaft sleeve seat 61. Vertical motion is limited by the left pull plate 56 being physically below the shaft sleeve seat 61 when the blocking mechanism 10 is assembled condition.

In order to provide for synchronized motion, so that the horizontal support bar 32 will raise and lower smoothly, a similar construction is provided at the other end of the horizontal support bar 32. The driving gear 50 drives a driven gear 62 which is fixedly attached to a shaft 64 rotatably mounted in a bearing base 66. At the right-hand end or second end of the blocking mechanism 10, the shaft 64 is rotatably mounted through a second bearing base 66A and has a second gear 68 fixedly mounted to the end thereof. There is a cam follower 70 rotatably mounted to the crankshaft 69 which moves in the oblong opening 70A of the second or right hand lifting plate 72. Rotation of the shaft 64 causes the second or left-hand pull plate 72 to reciprocate up and down at the same speed as the left hand pull plate 56. The second or left-hand pull plate is attached to the second or right-hand lifting shaft 74 which is attached by a crossbar 60A to the horizontal support bar 32.

To enable the position of the blocking pins to be determined, an upper photosensor 76 and a lower photosensor 78 are provided. An activating member 80, which rises and lowers with the reciprocation of the second or right-hand pull plate 72 will tell the photosensors (76, 78) where the position of the horizontal support bar 32 and thus, the blocking pins 22 are. The upper photosensor 76 and the lower photosensor 78 are carried on a sensor bracket 83 which is mounted in the mechanism by means well-known in the art.

If desired, the blocking mechanism 10 of the present invention may be converted into an autoclose blocking system by providing circuitry which detects when the power is on or off. If the power is turned off, or if the device is unplugged, the autoclose blocking system sends a signal to the motor 48 to return the pins to their down position, thus, completely prohibiting play. The power for this action is stored in the capacitors 84 for the autoclose blocking system. These are mounted by a fixing plate 86 to the second or right-hand base member 26 (FIG. 3). It may also be mounted in other desired positions depending on the application. The electronics for such a system are carried by the printed circuit board 82, and are well within the skill of those in the art.

An activation means 90, which may be such as a coin and/or bill acceptor, will accept the players' money and start rotating the motor 48 and drive gear 50. The photo sensors will allow the motor to run until the activating member 80 breaks the open space adjacent the upper photo sensor, causing the motor to stop in the up position, where the shuffleboard puck may be played. After the occurrence of a pre-determined event, the motor 48 will rotate the drive gear 50, moving both ends of the horizontal support bar down. When the activating member 80 breaks the open space adjacent the lower photo sensor, an electronic signal causes the motor to stop in this position. The blocking pins 22 are now in their lower position, preventing the pucks 18 from striking against the bumper, thus preventing play.

While the present invention is illustrated in connection with a shuffleboard game, it is well within the scope of the present invention that it be used on the many types of amusement games which are coin-operated, and have a playing surface.

By carefully investigating the problems present in the art concerning obtaining payment for amusement games, we have developed a unique and novel invention which solves many problems in the art.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A table type amusement game comprising, in combination;

a) a playing surface lying entirely within a single plane;

b) a playing piece;

c) a coin and/or bill acceptor;

d) a means for blocking mounted adjoining the playing surface and connected to the coin and/or bill acceptor such that the means for blocking moves between a raised open condition wherein a playing piece can pass under the blocking means and a lowered closed condition where a playing piece is blocked from passing under the blocking means; and e) a means for lifting connected to the blocking means which selectively moves the blocking means between the raised open condition where a playing piece can travel the entire length of the playing surface of the table type amusement game and the lower closed condition where a playing piece is blocked upon operation of the coin and/or bill acceptor.

2. The table-type amusement game described in claim 1, wherein the means for lifting is operated electrically.

3. The table-type amusement game described in claim 1, wherein when the means for blocking is in its first position, the playing piece is blocked from scoring.

4. The table-type amusement game described in claim 3, wherein when the means for blocking is in its second position, the playing piece may score.

5. The table-type amusement game described in claim 4, wherein the second position is the open position.

6. The table-type amusement game described in claim 3, wherein the first position is the closed position.

7. The table-type amusement game described in claim 1, wherein the playing piece is a shuffleboard puck.

8. The table-type amusement game described in claim 1, wherein the playing piece is a bowling ball.

9. The table-type amusement game described in claim 1, wherein the means for lifting is operated electrically and is connected to the coin and/or bill acceptor.

10. The table-type amusement game described in claim 1, wherein the means for lifting is operated mechanically.

11. The device defined in claim 1, wherein the means for blocking further comprises:

a) a means for guiding to guide a plurality of spaced apart blocking pins in a vertical motion;

b) a pin-mounting bar having a plurality of spring-mounted pins cooperating with the means for guiding to provide a plurality of vertically oriented pins for the means for guiding to guide.

* * * * *